United States Patent [19]

Applegate et al.

[11] Patent Number: 4,661,004

[45] Date of Patent: Apr. 28, 1987

[54] RIBBON FEED TENSION MECHANISM

[75] Inventors: Steven L. Applegate; James A. Craft, both of Lexington, Ky.

[73] Assignee: International Business Machines Corporation, Armonk, N.Y.

[21] Appl. No.: 728,980

[22] Filed: Apr. 30, 1985

[51] Int. Cl.[4] ..... B41J 33/52

[52] U.S. Cl. ..... 400/234; 400/208

[58] Field of Search ..... 400/194, 195, 196, 196.1, 400/207, 208, 208.1, 234, 618; 226/195; 242/55.19 R, 55.19 A, 147 R, 149, 156, 156.1, 189, 194, 197, 198, 199, 200

[56] References Cited

U.S. PATENT DOCUMENTS

| | | | |
|---|---|---|---|
| 3,642,225 | 2/1972 | Kakichi et al. | 242/199 X |
| 3,961,763 | 6/1976 | Somers | 242/199 |
| 4,034,935 | 7/1977 | Plaza et al. | 242/197 |
| 4,388,006 | 6/1983 | Waibel | 400/195 |
| 4,402,621 | 9/1983 | Abell, Jr. et al. | 400/208 |
| 4,408,908 | 10/1983 | Applegate et al. | 400/120 |
| 4,413,919 | 11/1983 | Applegate et al. | 400/208 |
| 4,468,139 | 8/1984 | Hattori | 400/120 |

FOREIGN PATENT DOCUMENTS

| | | | |
|---|---|---|---|
| 0083926 | 7/1983 | European Pat. Off. | 400/208 |

OTHER PUBLICATIONS

IBM Technical Disclosure Bulletin, "Ribbon Feed Mechanism", Craft, vol. 27, No. 1A, Jun. 1984, pp. 204–207.

*IBM Technical Disclosure Bulletin* article entitled "Molded Ribbon Cartridge With Brake," by J. A. Craft, vol. 25, No. 12, May 1983, at pp. 6676–6677.

*Primary Examiner*—Ernest T. Wright, Jr.

*Attorney, Agent, or Firm*—John A. Brady

[57] ABSTRACT

Member (9) has a tension arm (13) over which ribbon (3) feeds. Biasing arm (17) presses member (9) toward brake surface (7), with slot (21) moved until it encounters stud (23). At low tension of ribbon (3), brake surfaces (11) and (7) press and hold ribbon (3). As feed tension increases tension arm (13) forces member (9) back until stud (23) encounters the opposite end of slot (21), after which slightly higher force further opens the brake and arm (13) continues to provide feed tension. The mechanism is small, efficient, smooth functioning, and suited to incorporation as part of a ribbon cartridge.

24 Claims, 4 Drawing Figures

RIBBON FEED TENSION MECHANISM

TECHNICAL FIELD

This invention relates to the controlled feeding of thin ribbons, particulary typewriter ribbons. This invention provides a tension mechanism between a supply roll and the printing mechanism which is effective, mechanically uncomplicated, and may readily be incorporated into a cartridge housing the ribbon.

BACKGROUND ART

U.S. Pat. No. 4,408,908 to Applegate et al discloses a ribbon feed in which the ribbon is held between closed surfaces until the ribbon feed reaches a certain tension. The ribbon pulls on an arm which is rotated at the increased tension, to then physically contact and rotate a second member to open the closed surfaces and free the ribbon. This keeps sufficient tension on the ribbon to hold it on its feed path. The closed surfaces constitute a lock or brake which holds the ribbon from any feed from the ribbon supply until a desired, predetermined tension is reached. This avoids the feeding variations and inaccuracies which tend to occur when the ribbon tension is variable and uncertain.

*IBM Technical Disclosure Bulletin* article entitled "Molded Ribbon Cartridge With Brake" by J. A. Craft, Vol. 25, No. 12, May 1983, at pp. 6676–6677 shows a mechanism molded as part of a cartridge having a resilient brake arm closing on the ribbon and a separate, tension-spring arm. As the ribbon tension increases, the tension-spring arm is moved to a position at which it physically contacts the brake arm to open the closed surfaces and free the ribbon.

U.S. Pat. No. 4,468,139 to Hattori shows closed surfaces to apply ribbon tension during feeding. U.S. Pat. No. 4,402,621 to Abell, Jr. et al shows a spring around which the ribbon passes applying continuous tension to the ribbon, with no positive brake. Both of those mechanisms are incorporated in the ribbon cartridge. Applying some tension between a supply roll and a feed roll is common, as is incorporating some of those mechanisms in a ribbon cartridge. Accordingly, these patents are considered only representative of a variety of similar teachings.

SUMMARY OF THE INVENTION

In accordance with this invention, the tensioning apparatus of the foregoing U.S. Pat. No. 4,408,908 and *IBM Technical Disclosure Bulletin* article are replaced by a single moving part and a non-moving brake surface and two studs or surfaces, while the general mode of operation is retained. In this invention, a shifting pivot point provides a nearly constant tension transition between the open and closed brake positions. The moving part may be plastic molded as a single piece.

The entire mechanism may be integrated in the ribbon cartridge, and incorporation in the cartridge may be essential when more than one cartridge is to be stacked, since space is generally not available off the cartridge for several tensioning systems. Also, this invention is so small and efficient that providing it in the cartridge may be desirable to avoid operator involvement in threading the ribbon through a tensioning mechanism when the ribbon is loaded for use.

The movable member has a long tension arm over which the ribbon feeds. The tension arm is caused to rotate by the ribbon during ribbon feed as ribbon tension increases. A shorter, biasing arm is generally opposite and spaced from the tension arm. (The biasing arm could alternately be a separate spring.) Both arms are integral with a base member having an elongated slot. In use, the slot in the base member is mounted on a fixed stud for movement between two positions in which the pin is disposed in one or the other ends of the slot. The biasing arm is flexed toward the tension arm by another fixed stud. This forces the tension arm toward a stationary brake surface, with the tension arm and stationary surface closed on the ribbon and acting as a brake. As ribbon tension increases during ribbon feed, pressure between the brake surfaces reduces. A level of tension is reached at which the force of the bias arm is overcome and the base begins to move to the opposite position with respect to the stud in its slot. During that period, the closing force of the brake remains generally constant at the lower force existing at the start of the movement. The base subsequently finds a new pivot point at the opposite end of the slot, causing opening of the brake and permitting operation of the tension arm for providing continuing, near-constant tension to the ribbon.

BRIEF DESCRIPTION OF THE DRAWING

This invention is described in detail below with reference to the accompanying drawing, which illustrates the preferred and alternate embodiment, in which.

BEST MODE FOR CARRYING OUT THE INVENTION

Figure 1:
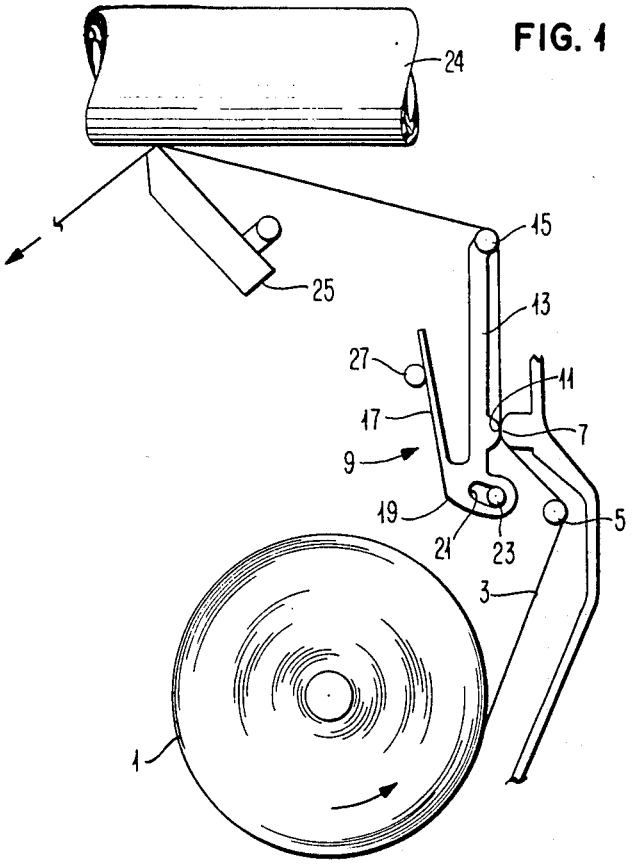
FIG. 1 is a top view of the mechanism incorporating the present invention which illustrates the mechanism in a fixed position in which ribbon tension is low.

Referring to FIG. 1, a supply spool 1 of ordinary printer ribbon 3 (which, in the illustrated embodiment, is in essence a polycarbonate support layer carrying a meltable thermal ink) turns counterclockwise to unwind ribbon 3 for printing. Ribbon 3 passes around a stationary guide 5 and extends to the surfaces of stationary brake surface 7. Moveable member 9 has a protruding brake surface 11 which closes on ribbon 3.

Member 9 has a relatively long tensioning arm 13 having a guide surface 15 at its end, which ribbon 3 wraps partially around. A biasing arm 17 is located generally parallel to tensioning arm 13. In the illustrated instance, both arms 13 and 17 are integral with base member 19, which has an elongated slot 21. Stationary stud 23 is located in slot 21.

Ribbon 3 extends to a platen 24, where it is pressed between platen 24 and printhead 25 (for thermal printing in this preferred embodiment), as is conventional. Ribbon feed is accomplished by pulling ribbon 3 at any point past tensioning arm 13. This may be done in any conventional manner, including the method shown in the foregoing U.S. Pat. No. 4,408,908.

Member 9 is molded in one piece of DELRIN acetal resin. This resin is readily molded, but another resilient polymer could be used. The non-flexed position of biasing arm 17 would be behind stationary post 27. Arm 17 is assembled before post 27 as shown and therefore biases member 9 toward brake surface 7, resulting in slot 21 moving away from surface 7 until stud 23 encounters the right end of slot 21 as shown in FIG. 1.

FIG. 1 shows the status of the assembly when the tension along ribbon 3 is low. Brake surfaces 11 and 7 are closed on ribbon 3 with sufficient engagement pressure on ribbon 3 from the bias provided by tensioning arm 13 to prevent longitudinal movement of ribbon 3 to or from the supply spool 3. In this region, brake surfaces 11 and 7 act as the pivot point for member 9. Increases in longitudinal tension of ribbon 3 apply force on tension arm 13 directed away from fixed brake surface 7 and therefore reduces the brake pressure on ribbon 3. This continues during the initial period of ribbon feed until a consistent, high tension builds up on ribbon 3.

Figure 2:
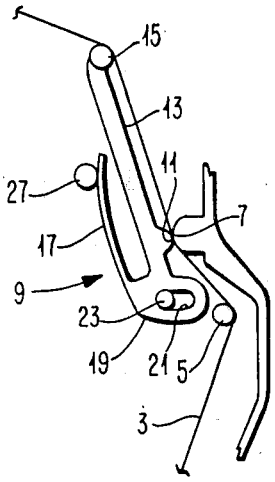
FIG. 2 is an identical view to FIG. 1, but only of the tensioning assembly, which illustrates the mechanism in a second position when ribbon tension is higher.

At that point, the force on tension arm 13 from ribbon 3 overcomes that from biasing arm 17 and the slot 21 on member 9 moves until stud 23 encounters the end of slot 21 opposite to that at the low tension. Slot 21 and stud 23 then become the pivot point for member 9. This status is shown in FIG. 2. Thus, the pivot point for member 9 shifts from the brake surfaces 7, 11 to stud 23 and the side of the slot 21 nearest biasing arm 17. That repositioning of member 9 along slot 21 increases significantly the flexing of biasing arm 17 which brake pressure on ribbon 3 does not change significantly. This provides an operating characteristic having a desired near-constant longitudinal tension on ribbon 3 during the period when brake surfaces 11 and 7 are at a reduced closing force and ribbon 3 is therefore beginning to be fed from supply spool 1.

Figure 3:
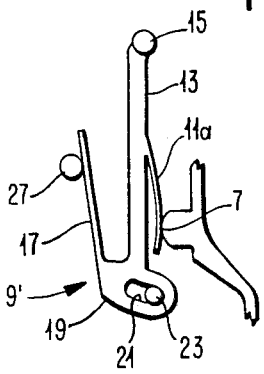
FIG. 3 illustrates an alternative embodiment of the moveable member shown in the other figures.

FIG. 3 shows an alternative form 9' of member 9 in which brake surface 11 is replaced by a resilient, flexed arm 11*a*. This provides assured brake engagement and a still more gradual transition from the braked to the unbraked position, since arm 11*a* continues to close on countersurface 7 as member 9' moves along slot 21, but at a reduced force not causing complete braking.

Figure 4:
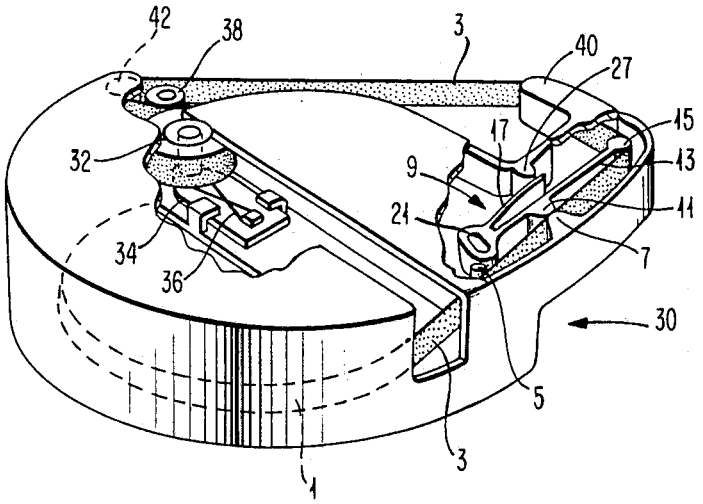
FIG. 4 is a perspective view of a preferred embodiment having the tensioning assembly incorporated in a cartridge.

FIG. 4 illustrates a full cartridge 30 incorporating this tensioning system. This cartridge 30 has the supply spool 1 below a takeup spool 32, a generally conventional configuration. As the position of the two spools 1, 32 have no essential influence on the operation of this invention, relative location of spool 1 and spool 32 could be as illustrated or could be separated on the same plane, as is also generally conventional.

In the illustrated instance, take-up spool 32 is mounted on a sliding support 34 and support 34 is yieldably biased toward the side of cartridge 30 by spring 36. Drive roll 38 is permanently mounted on the machine and cartridge 30 is mounted with the periphery of take-up spool 32 contacting drive roll 38. As take-up spool 32 increases in size by adding used ribbon 3, support 34 moves away from drive roll 38, whil spring 36 provides tension toward drive roll 38 to assure driving contact. This is generally conventional.

Ribbon 3 is directed upward from supply spool 1 to the plane of take-up spool 32 around guide 5 and between brake surfaces 7 and 11 and over the end 15 of tensioning arm 13 at about a 90° angle. Surface 7 and post 27 are integral with the side walls of cartridge 30. Ribbon 3 exits cartridge 30 at exit arm 40 and is guided by the end of arm 40 toward guide post 42 in cartridge 30 near drive roll 38 and then between drive roll 38 and takeup spool 32.

Ribbon feed occurs by turning drive roll 38. Initially, the tension in ribbon 3 increases as surfaces 7 and 11 serve as a complete brake. Then the brake action is smoothly released and member 9 moves as described in the foregoing. Ribbon 3 is then supplied from spool 1 under forces originating from drive roll 38. Terminating of drive from roll 38 results in some movement of ribbon 3 by momentum of supply spool 1, with resulting reduction of tension of ribbon 3 and reversal of the action of member 9. Motion of the printhead 25 (FIG. 1) away from platen 24, such as during carrier return and between continuous printing operations, also reduces the tension in ribbon 3 and reverses the action of member 9. The relative slack created when printhead 25 retracts is absorbed initially by tension arm 13 rotating and then by base 19 shifting through the interaction of slot 21 and stud 23. This keeps sufficient tension on ribbon 3 to hold it on a ribbon feed path.

It will be apparent that this invention may be implemented in various forms and may be incorporated in or be separate from a cartridge holding a ribbon being fed.

What is claimed is:

1. A member for controlling feed tension of a flexible ribbon, said member having a tension arm for contacting said ribbon and for applying tension along the length of said ribbon, said tension arm having a brake surface to brake said ribbon by said brake surface and a second surface closing on said ribbon, a base member integral with said tension arm and having an elongated slot, a biasing arm integral with said base member generally opposite and spaced from said tension arm and having resiliency for flexing said biasing arm toward said tension arm to bias said brake surface toward said second surface while tending to move said base member generally away from said second surface.

2. The member as in claim 1 in which said brake surface is a flexible arm.

3. The member as in claim 1 being one, continuous body of a resilient plastic.

4. The member as in claim 2 being one, continuous body of a resilient plastic.

5. A member for controlling feed tension of a flexible ribbon, said member having a tension arm for contacting said ribbon and for applying tension along the length of said ribbon, said tension arm having a brake surface for pressingly engaging said ribbon against a second surface, a base member connected to said tension arm and having means defining an elongated slot, a flexible and resilient biasing arm connected to said base member and generally parallel to said tension arm so that flexing said biasing arm toward said tension arm biases said brake surface toward said second surface while tending to move said base member generally away from said second surface.

6. The member as in claim 5 in which said brake surface is a flexible arm.

7. The member as in claim 5 being one, continuous body of a resilient plastic.

8. The member as in claim 6 being one, continuous body of a resilient plastic.

9. A mechanism for controlling feed tension of a flexible ribbon comprising, a tension arm contacting said ribbon to be caused to rotate by said ribbon, a first brake surface on said tension arm, a second brake surface opposite said first brake surface to brake said ribbon by said first brake surface and said second brake surface closing on said ribbon, a base on which said tension arm is mounted and having an elongated slot, a guide surface in said elongated slot for permitting said base to move to two positions fixed by said guide surface encountering opposite ends of said slot, means to bias said tension arm toward said second brake surface to cause said base at low ribbon tension to move with said slot toward said second brake surface with said first and said second brake surfaces closed on said ribbon and to permit said flexible arm at higher ribbon tension to move said base away from said second brake surface to open said first and said second brake surfaces and to apply tension to said ribbon.

10. The member as in claim 9 in which said first brake surface is a flexible arm.

11. The member as in claim 9 in which said means to bias comprises a resilient biasing arm mounted on said base generally opposite and spaced from said tension arm and a surface positioned to flex said biasing arm, and in which said tension arm, said first brake surface, said base, and said biasing arm are one, continuous body of a resilient plastic.

12. The member as in claim 10 in which said means to bias comprises a resilient biasing arm mounted on said base generally opposite and spaced from said tension arm and a surface positioned to flex said biasing arm, and in which said tension arm, said first brake surface, said base, and said biasing arm are one, continuous body of a resilient plastic.

13. The mechanism as in claim 9 being elements in a single cartridge.

14. The mechanism as in claim 10 being elements in a single cartridge.

15. The mechanism as in claim 11 being elements in a single cartridge.

16. The mechanism as in claim 12 being elements in a single cartridge.

17. A mechanism for controlling feed tension of a flexible ribbon comprising a tension arm contacting said ribbon to be caused to rotate by longitudinally tensioning said ribbon, a pair of opposed ribbon brake surfaces for pressingly engaging said ribbon therebetween, said pair of brake surfaces comprising a first brake surface on said tension arm and a second brake surface fixedly positioned with respect to said first brake surface, a base to which said tension arm is connected and having means defining an elongated slot in said base, guide means in said means defining said slot and including a guide surface for permitting said base to move between two positions fixed by said guide surface encountering opposite terminal ends of said slot, means to bias said tension arm toward said second brake surface to cause said base at low ribbon tension to move with said slot toward said second brake surface with said first and said second brake surfaces pressingly engaging said ribbon and to permit said flexible arm at higher longitudinal ribbon tension to move said base away from said second brake surface at reduced pressure between said first and said second brake surfaces and to apply tension to said ribbon.

18. The member as in claim 17 in which said first brake surface is a flexible arm.

19. The member as in claim 17 in which said means to bias comprises a flexible and resilient biasing arm connected to said base generally parallel to said tension arm and fixed means positioned to flex said biasing arm, and in which said tension arm, said first brake surface, said base, and said biasing arm are one, continuous body of a resilient plastic.

20. The member as in claim 18 in which said means to bias comprises a flexible and resilient biasing arm connected to said base generally parallel to said tension arm and fixed means positioned to flex said biasing arm, and in which said tension arm, said first brake surface, said base, and said biasing arm are one, continuous body of a resilient plastic.

21. The mechanism as in claim 17 being elements in a single cartridge.

22. The mechanism as in claim 18 being elements in a single cartridge.

23. The mechanism as in claim 19 being elements in a single cartridge.

24. The mechanism as in claim 20 being elements in a single cartridge.

* * * * *